US009820628B2

(12) United States Patent
Zorzo

(10) Patent No.: US 9,820,628 B2
(45) Date of Patent: Nov. 21, 2017

(54) LOCKING AND UNLOCKING KINETIC MOTION OF A MOP BASE

(75) Inventor: Renato Zorzo, Onara (IT)

(73) Assignee: T.T.S.s.r.l, S. Giustina in Colle (IT)

( * ) Notice: Subject to any disclaimer, the term of this patent is extended or adjusted under 35 U.S.C. 154(b) by 704 days.

(21) Appl. No.: 14/241,207

(22) PCT Filed: Jul. 30, 2012

(86) PCT No.: PCT/IB2012/053891

§ 371 (c)(1),
(2), (4) Date: Feb. 26, 2014

(87) PCT Pub. No.: WO2013/018022

PCT Pub. Date: Feb. 7, 2013

(65) Prior Publication Data

US 2014/0215740 A1 Aug. 7, 2014

(30) Foreign Application Priority Data

Aug. 3, 2011 (IT) ..... PD2011A0259

(51) Int. Cl.

| | |
|---|---|
| ***A47L 13/256*** | (2006.01) |
| ***A47L 13/258*** | (2006.01) |
| ***A47L 13/254*** | (2006.01) |
| *A47L 13/20* | (2006.01) |

(52) U.S. Cl.

CPC ..... *A47L 13/254* (2013.01); *A47L 13/258* (2013.01); *A47L 13/20* (2013.01); *A47L 13/256* (2013.01)

(58) Field of Classification Search

CPC ..... A47L 13/44; A47L 13/256; A47L 13/46; A47L 13/254

USPC ..... 15/147.1, 147.2, 150, 228, 258

See application file for complete search history.

(56) References Cited

U.S. PATENT DOCUMENTS

| | | | | |
|---|---|---|---|---|
| 5,461,749 | A * | 10/1995 | Ahlberg | A47L 13/256 15/150 |
| 5,864,914 | A * | 2/1999 | Salmon | A47L 13/258 15/147.2 |
| 7,854,035 | B2 * | 12/2010 | Gullicks | A47L 13/258 15/147.1 |
| 8,065,775 | B2 * | 11/2011 | Cameneti | A47L 13/256 15/147.1 |
| 2001/0013153 | A1 * | 8/2001 | Zorzo | A47L 13/254 15/247 |
| 2002/0152569 | A1 * | 10/2002 | Zorzo | A47L 13/258 15/147.1 |
| 2003/0074757 | A1 * | 4/2003 | Brinker | A47L 13/20 15/228 |
| 2007/0022553 | A1 * | 2/2007 | Niemeyer | A47L 13/256 15/228 |
| 2007/0107153 | A1 * | 5/2007 | Gullicks | A47L 13/258 15/147.1 |

(Continued)

FOREIGN PATENT DOCUMENTS

| | | | | |
|---|---|---|---|---|
| IT | EP 2071998 | A1 * | 6/2009 | A47L 13/258 |
| WO | 03/039321 | A1 | 5/2003 | |

(Continued)

*Primary Examiner* — Michael Jennings

(74) *Attorney, Agent, or Firm* — Quickpatents, LLC; Kevin Prince

(57) ABSTRACT

Improved mop base capable of using both surfaces of a normal mop arranged parallel to one another.

9 Claims, 7 Drawing Sheets

(56) References Cited

U.S. PATENT DOCUMENTS

2010/0101039 A1* 4/2010 Cameneti ..... A47L 13/256
15/228

FOREIGN PATENT DOCUMENTS

WO 2006/002654 A1 1/2006
WO 2006002653 A1 1/2006

* cited by examiner

LOCKING AND UNLOCKING KINETIC MOTION OF A MOP BASE

CROSS-REFERENCE TO RELATED APPLICATIONS

This application claims the benefit of Italian Patent Application PD2011A000259, filed on Aug. 3, 2011, and PCT Application PCT/IB2012/053891, filed on Jul. 30, 2012, both incorporated herein by reference.

STATEMENT REGARDING FEDERALLY SPONSORED RESEARCH AND DEVELOPMENT

Not Applicable.

FIELD OF THE INVENTION

The field of the invention concerns cleaning articles, in particular mop bases and more precisely their kinematic locking and unlocking system, aimed at holding a mop base in a stable position, both open and closed.

DISCUSSION OF RELATED ART

Generally we consider a mop base to be composed of at least two elements or half-frames, very often hinged together, that can take on a configuration for holding the mop, defined as a closed condition of the mop base, and a configuration that does not hold the mop, or open, which is used for removing and/or replacing the mop of the relative base.

As is well known, mop bases are used widely in the field of cleaning floors in the home, and by most cleaning companies for the dry and wet cleaning of floors.

The mop that is used has to be held in a stable manner by the relative mop base during the cleaning operations, but also has to be able to be easily removed and replaced when needed, to be replaced during such operations with a new clean cloth or mop.

Generally when being used the mop base grips in a pincer fashion, or with other devices that are fixed to it, the mop in the correct position with respect to the base.

When it needs to be replaced, the mop base has to allow it to be easily replaced, freeing it from its grip and providing available space for its insertion and the mutual attachment between the mop base and the new clean mop.

Recently, in mop bases on the market, very beneficially the two conditions of opening and closing have been made fixed conditions.

Nevertheless, the device that provides at least one of the two positions and allows the passage from one to the other has shown to have various drawbacks.

The reliability, practicality, simplicity of construction and use are the aspects that operators take into consideration and appreciate the most.

Indeed, each of the above-mentioned characteristics is an absolute necessity for the user and determines the commercial success of the base itself.

Another very important aspect for the cleaning operator is that the opening and closing kinetic movement should not constitute an encumbrance during normal cleaning operations, and that it should also allow the mop to be wrung inside a mop wringing device, also whenever said mop is still attached to the mop base.

Another important characteristic for the user is that the relative control of the locking and unlocking movement should be easily recognisable and handled, avoiding controls being exposed that cannot and/or should not be handled, not even inadvertently.

However on the market there is no device that succeeds in combining all the above-mentioned characteristics.

SUMMARY OF THE INVENTION

The purpose of this invention is to make available a kinetic system for locking and unlocking, in at least one of the stable conditions, a mop base, which overcomes the drawbacks of the prior art.

Another purpose of this invention is to make available a device that does not constitute an encumbrance during cleaning operations.

Another purpose of this invention is to make available a locking and unlocking kinematic system which, when employed on a mop base, can be inserted in a wringing device with the relative mop still attached to the mop base, without said kinematic system interfering with the wringing elements.

Another purpose of this invention is to make available a kinematic system that provides the operator with just a single control for the situation where the mop base finds itself.

Another purpose of this invention is to make available a kinematic system that highlights and makes available the control that needs to be used for changing the stable situation of the mop base.

Another purpose of this invention is to make available a kinematic system that can be easily handled from any side of the mop base.

Another purpose of this invention is to make available a kinematic system that does not respond to any mistaken operations by the operator.

All the aims mentioned above are attained by a kinematic system for locking and unlocking in at least one of the stable conditions of a mop base according to the attached claims.

Said device also attains other aims that will become evident in this description.

The object of the invention is a locking and unlocking kinematic system, composed of at least two half-frames, basically flat and hinged together along a common longitudinal axis and capable of retaining a free edge of a mop inside a clasping mouth composed a pair of longitudinal edges, belonging to the same side of each half-frame, where said kinematic system is capable of assuming and maintaining a stable position between that of opening and that of closing of said mop base, comprising a hinged kinematic system on a first half-frame (lower half-frame) that, when the mop base is closed, is held by the second half-frame, whereas when the mop base is open it is, when forced to rotate by elastic devices, exposed beyond the profile of said second half-frame, interfering with its profile when said second half-frame returns to a closed state.

Beneficially, said kinetic system is composed of a lever and elastic thrust elements of said lever, where said lever is hinged with its axis parallel to the reciprocal hinging axis of the two half-frames that constitute the mop base.

Another advantage of this lever is that it is within the profile of the mop base, not protruding beyond the outline, thereby avoiding the possibility of it getting caught during cleaning operations or becoming a protruding obstacle.

Another beneficial characteristic of this lever is that the interference of its profile with the second half-frame, which prevents the return of the second half-frame to the closed condition of the mop base, is carried out on a counter surface, configured as a continuous groove with an axis parallel to the hinging axis of the lever.

Beneficially said interference is created by a tooth, protruding, at least partially, beyond the profile of the lever.

Beneficially said groove, or said tooth, is profiled with a surface for countering the return of the second half-frame when the mop base is closed, like a wall arranged perpendicular to the profile of the lever, preferably perpendicular to the plane passing through said wall and the axis of the hinging of said lever.

Beneficially, the unlocking of the mop base from the open state for restoring the closed position occurs with the operator using his foot on the lever, which protrudes beyond the profile of said second half-frame, countering the elastic elements that act on said lever, and causing a partial rotation of said lever until the interference between said groove, or tooth, and said second half-frame of the mop base is negated.

Beneficially, once said interference between said groove or tooth and said second half-frame of the mop base has been negated, said second half-frame is rendered free to take up its closed state again, and rotates pushing said lever, forcing it to rotate until it goes inside the second half-frame.

Beneficially the thrust of the second half-frame on said lever occurs on an inclined surface adjacent to said groove or tooth.

These and other aims are all attained by the improved mop base, according to the attached claims.

Said mop base also attains other aims that will become evident in the description.

DESCRIPTION OF THE DRAWINGS

The technical characteristics of the invention, in line with the above-mentioned objectives, can clearly be found in the contents of the claims above and the benefits of it are even more evident in the detailed description that follows, made with reference to the attached diagrams, which depict a form that is purely by way of example and non-binding, where:

DETAILED DESCRIPTION OF THE PREFERRED EMBODIMENT

Figure 1:
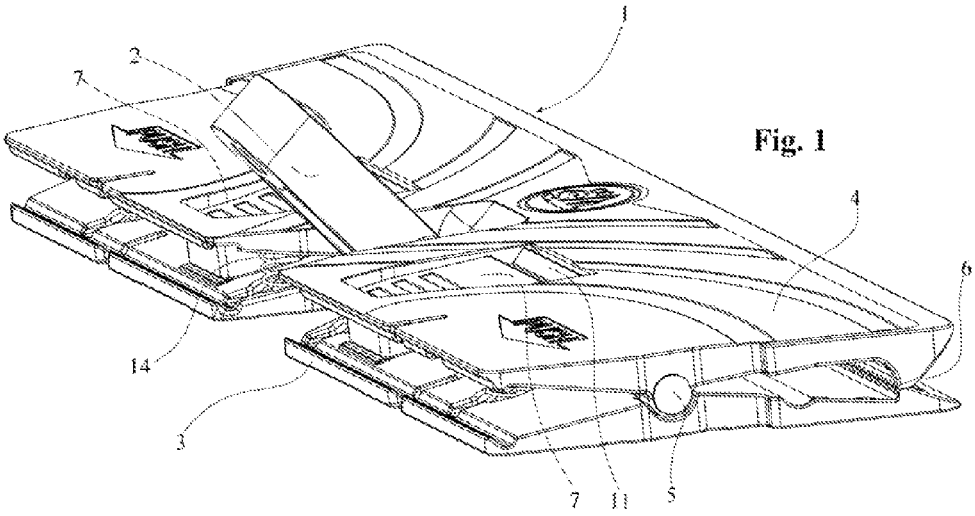
FIGS. 1 and 2 show an axonometric view of a mop base equipped with the object of this invention, in a closed state and an open state respectively.

With reference to the diagrams, the mop base, indicated generally with 1, has a connecting joint 2 for a handle, hinged to at least one half-frame 3, 4 constituting said base 1 or to the same reciprocal hinging axis 5 of the half-frames 3, 4 constituting the mop base 1.

Figure 2:
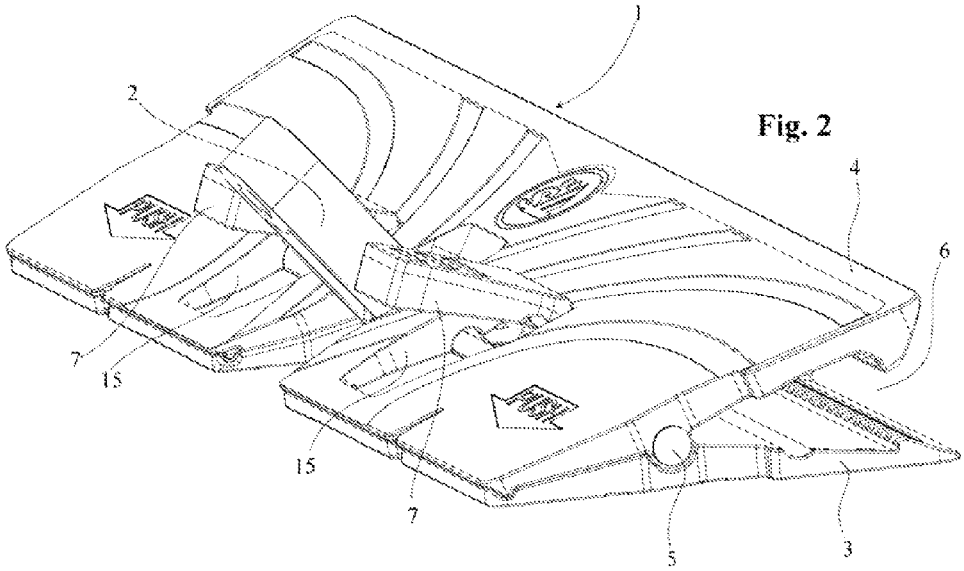
Figure 3:
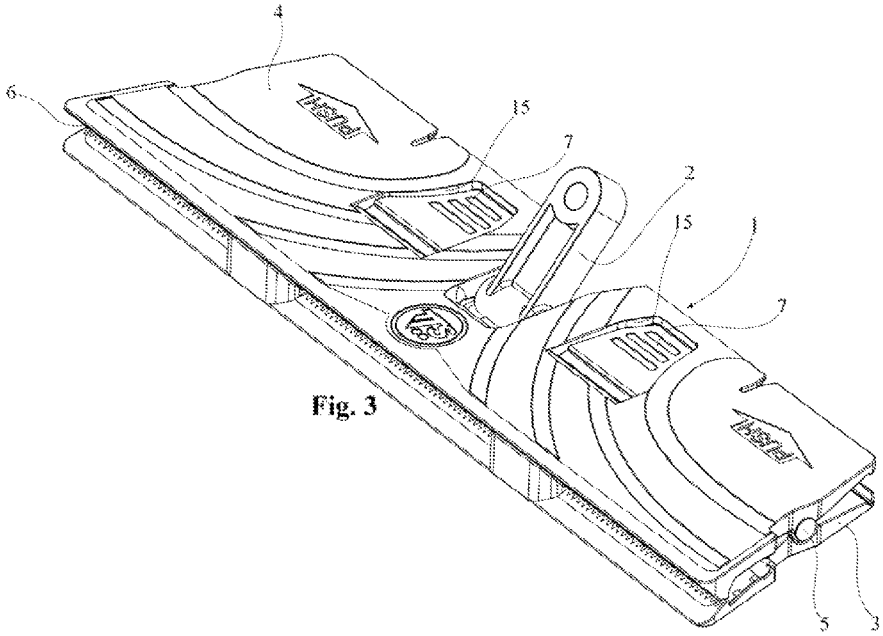
FIGS. 3 and 4 show a second axonometric view of the mop base of FIGS. 1 and 2, in a closed state and an open state respectively.
Figure 4:
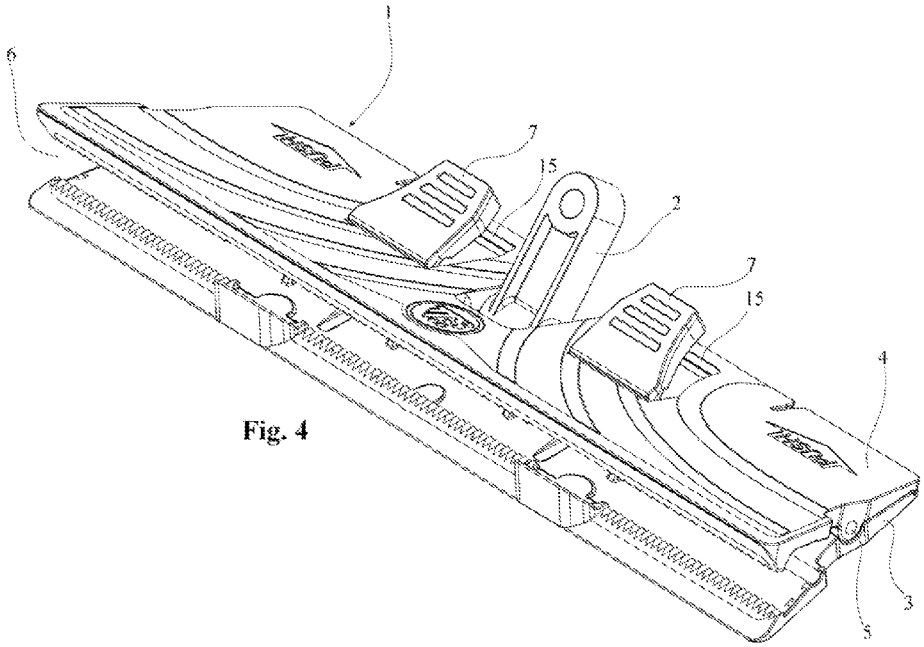
Figure 5:
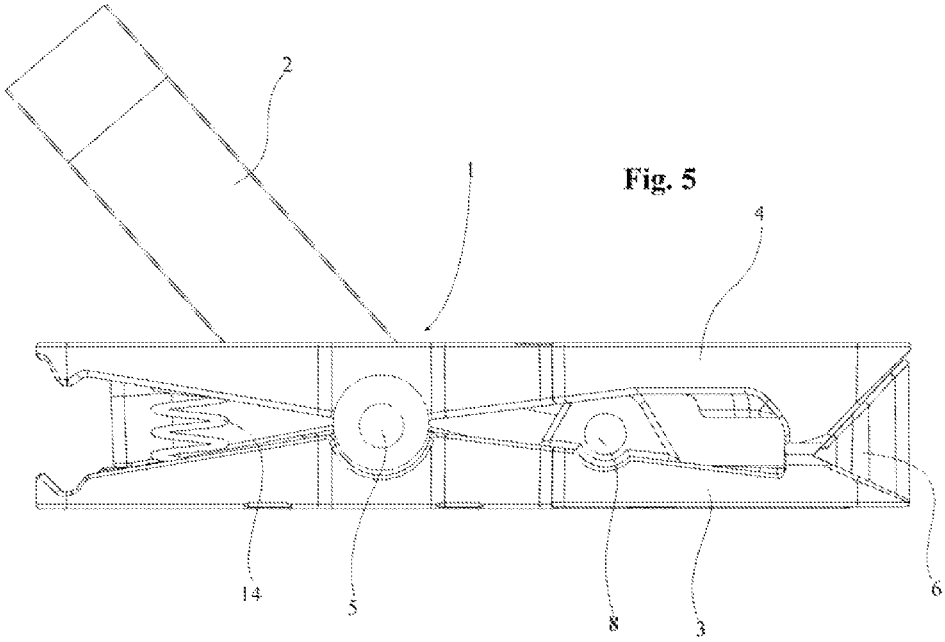
FIGS. 5 and 6 show a side plane view of the mop base of FIGS. 1 and 2 respectively.
Figure 6:
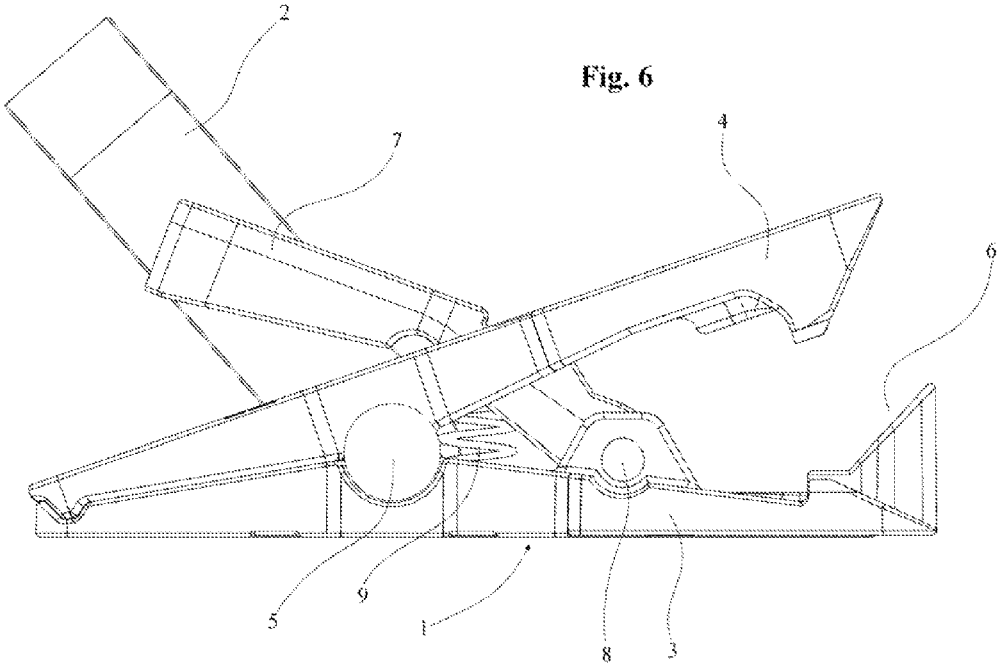
Figure 7:
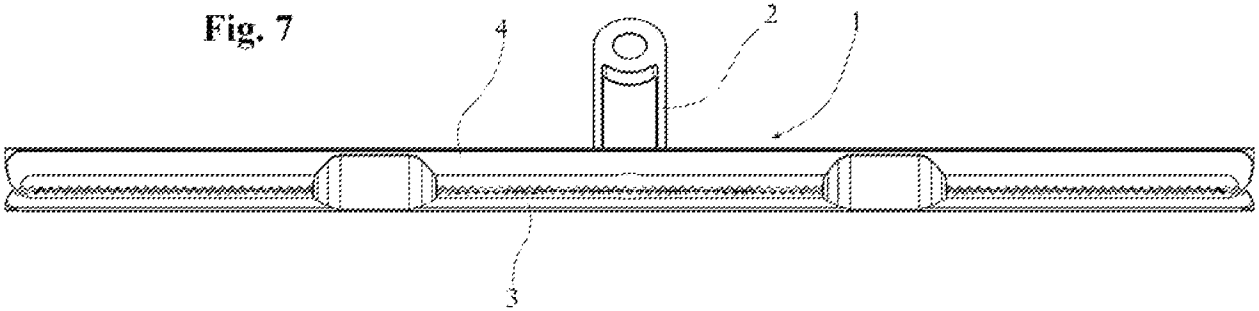
FIGS. 7 and 8 show a front plane view of the mop base of FIGS. 1 and 2 respectively.
Figure 8:
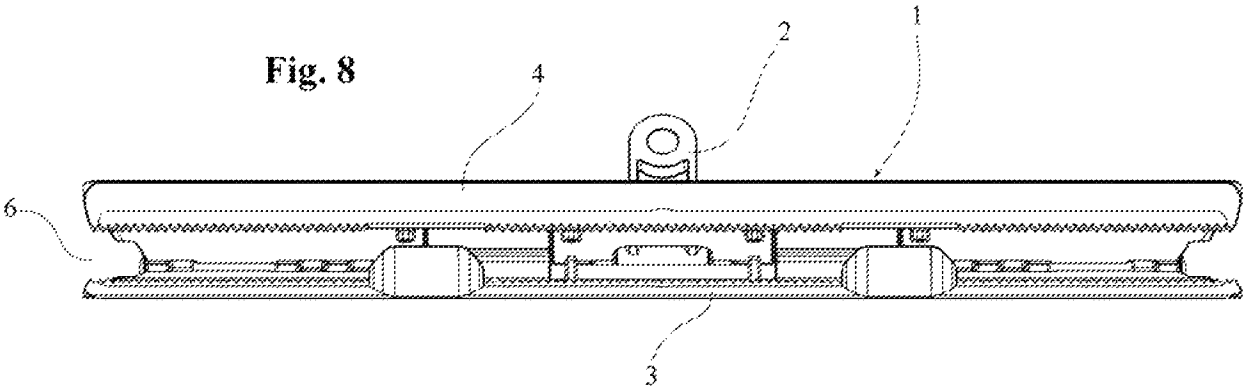
Figure 9:
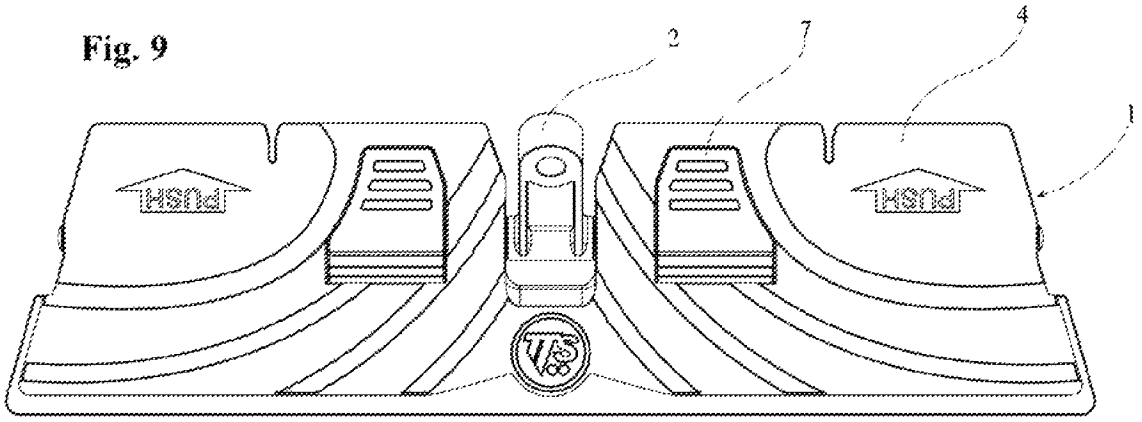
FIGS. 9 and 10 show a plane view from above of the mop base of FIGS. 1 and 2 respectively.
Figure 10:
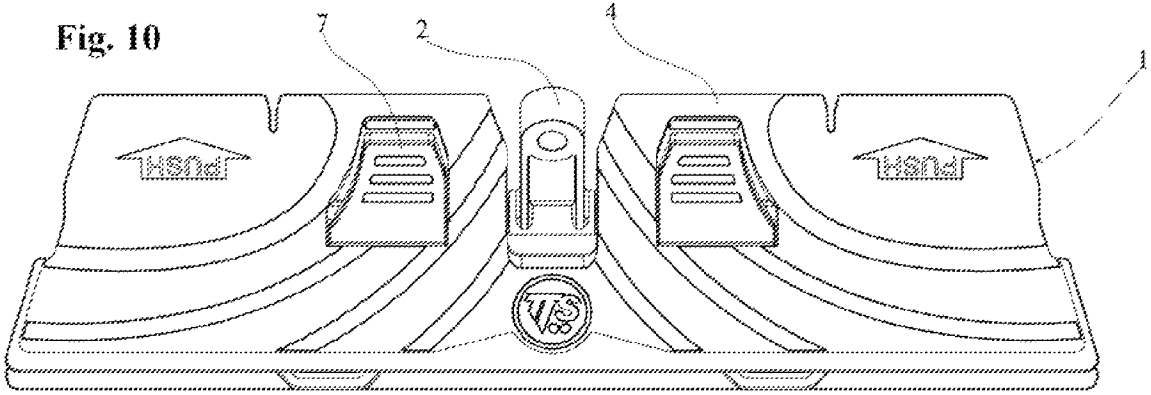
Figure 11:
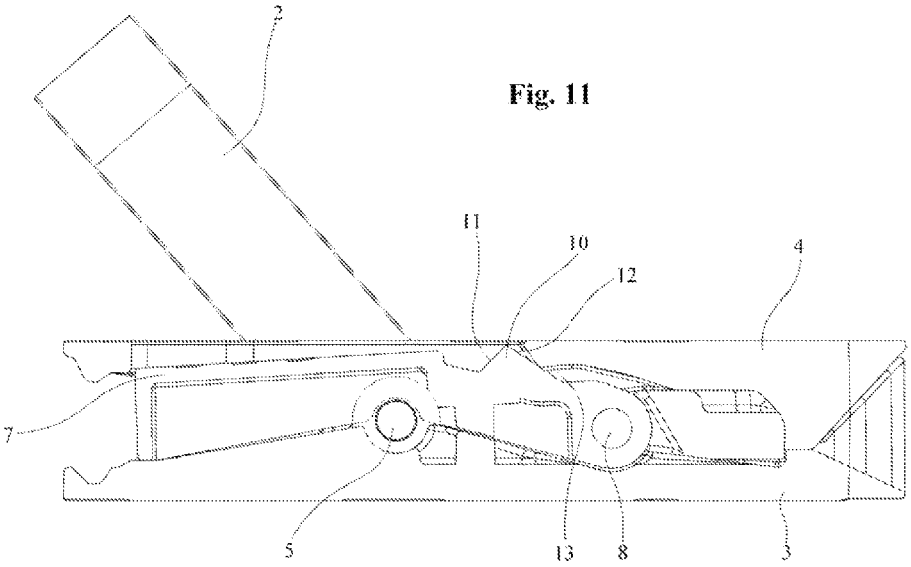
FIGS. 11 and 12 show a cross section view of the mop base of FIGS. 5 and 6 respectively for the lever of the locking and unlocking kinematic system and perpendicular to the hinging axis of said lever.
Figure 12:
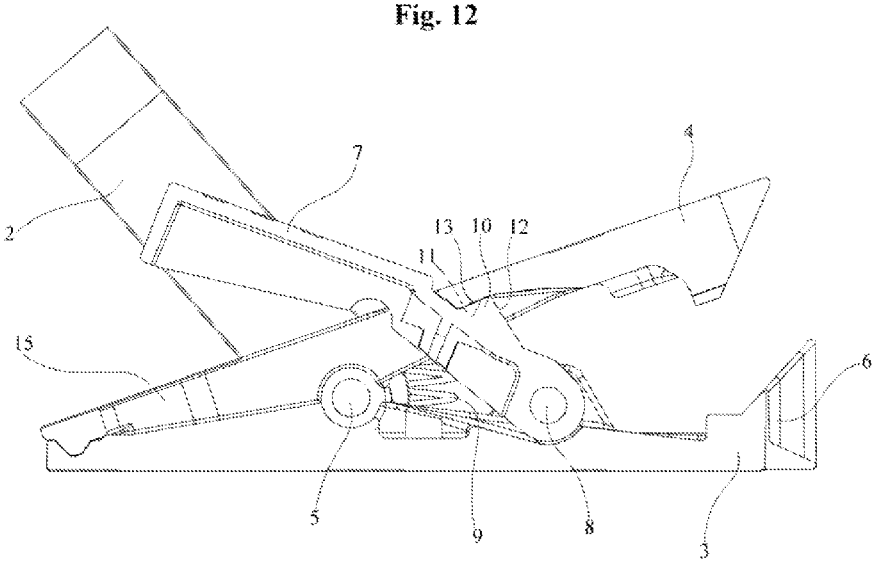
Figure 13:
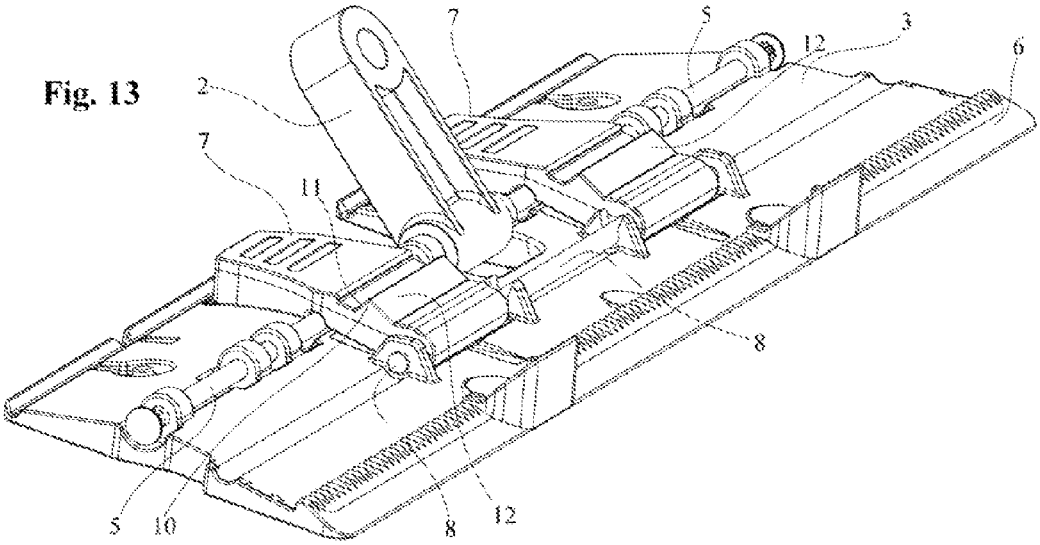
FIGS. 13 and 14 show the mop base of FIGS. 1 and 2 respectively with the top half-frame removed.
Figure 14:
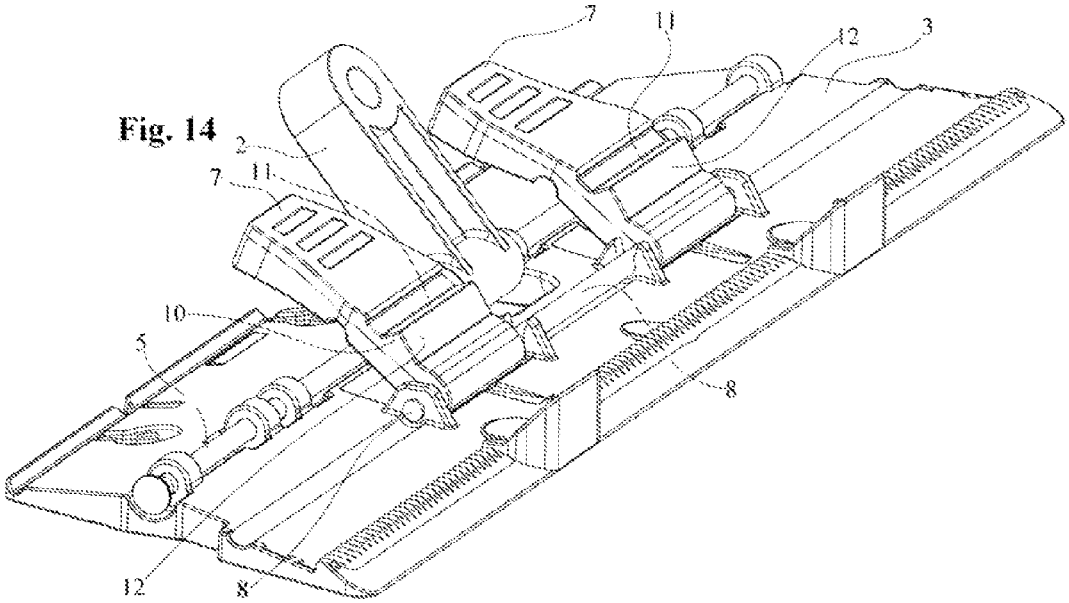

Said half-frames 3, 4, constituting the mop base 1, can take on two distinct configurations with respect to the front or mouth part 6 for holding the mop, a first open configuration of the mop base, as shown in FIG. 2, with a divergent arrangement of said half-frames 3, 4 with respect to the mouth 6; and a second closed configuration of the mop base, as shown in FIG. 1, with a juxtaposed arrangement of said half-frames 3, 4 with respect to the mouth 6.

It is important to note that the lever 7 of the kinematic system for locking and unlocking the mop base is contained inside the mop base 1 itself in the closed configuration and protrudes beyond the profile of the top half-frame 4 in the open configuration.

Both configurations of the mop base 1, open and closed, are stable configurations.

Said lever 7 is hinged to the lower half-frame 3 of the mop base 1, with the axis 8 parallel to the reciprocal hinging axis 5 of the half-frames that make up the mop base 1.

Said lever 7, pushed by elastic elements 9 to rotate towards the top half-frame, constitutes the locking and unlocking kinematic system, which takes on a rest arrangement adjacent, in proximity and non-protruding with respect to the external surface defined by the top half-frame, in the closed mop base 1 configuration, and takes on an active protruding configuration, beyond the external profile defined by the top half-frame 4 in the open mop base configuration.

The resting state of said kinematic system is maintained by the interference of the half-frame 4 with the lever 7, which 4 holds the lever 7 inside the mop base 1, while in the active state of the kinematic locking and unlocking, the tooth 10, on the top face of the lever 7, and positioned underneath the top half-frame, counters and prevents the return to its closed configuration, ensuring a sufficient opening of the mouth 6 for the replacement of the mop with a fresh clean one.

The change of state of the mop base 1 from closed to open takes place following the pressure exercised on the top outer surface of the top half-frame, on the side facing the operator and opposite that of the mouth 6, and the consequent rotation of said top half-frame with respect to the hinging to the lower half-frame.

It should be noted that in this situation, with the mop base 1 closed, the lever 7 that is inside the profile of the mop base 1 is not available for any operation.

This pressure of the operator, applied using his foot, forces the relative rotation of the top half-frame 4 with respect to the lower half-frame 3, opening on the opposite side the gripping mouth 6 of the mop.

Near the maximum available opening, the kinematic locking system starts to work, pushed by elastic elements 9, leading the tooth 10 on the lever 7 to settle underneath the top half-frame, in association with an adequate notch 13 and preventing the top half-frame returning to the closed state.

It is clear that a similar function of the tooth 10 can be carried out by a groove, hollowed out into the profile of the lever 7 and parallel to the hinging axis.

Beneficially, the returning action exercised by the top half-frame 4, acting through the notch 13 on the tooth 10, is practically perpendicular to the face 11 on the tooth 10 (or on a similarly configured groove), the open state is a stable state.

The change from an open to closed state of the mop base 1 takes place following the pressure exercised by the lever 7 of the kinematic unlocking system that protrudes with respect to the top half-frame.

It should be noted that this lever 7 is practically the only element that the operator can use in this situation, because it is much higher with respect to the top half-frame 4, and because the lowered side of the top half-frame 4 next to the lower half-frame 3, in contact with the floor, is inactive.

This pressure on said lever 7, countering the elastic components 9 acting on said lever, creates a rotation, with respect to the hinging 8, that shifts the counter surface 11 of the tooth 10 from the notch 13 on the lower side of the top half-frame 4.

This decoupling leads to an immediate restoration of the upper half-frame 4 to the closed state of the mop base 1.

Moreover, shaping said lever 7 with an inclined surface 12, preferably near said tooth 10, the half-frame 4, which tends to regain its closed state under the action of second elastic components 14, acting on said inclined surface 12, brings the locking and unlocking device back to the rest condition, adjacent to the upper half-frame 4.

Beneficially, on said top half-frame 4 there is a window 15, which contains the lever 7 of the kinematic system during the closed state of the mop base and from which it emerges when the mop base is in an open state.

Preferably the arrangement of this lever 7 during the closed state of the mop base, inside the window 15, is flush with the external surface of the upper half-frame 4, creating a continuity of the surface, useful as an active counter surface if the mop base has to be used overturned, namely with the top half-frame set adjacent to the floor and useful when the mop base is inserted in a wringer with the mop attached.

It is very clear that an arrangement of the kinematic system that altered the continuity of the flatness would impede the use of both sides of the mop base as surfaces that could be placed next to the floor, and therefore the use of both sides of the mop attached to the mouth of the mop base.

It is equally evident that an arrangement of the kinematic system that altered the continuity of the surface countering the mop would impede the mop attached to the base of the mop from being wrung properly inside a wringer for a mop.

The above-mentioned drawbacks are, as can be seen, cleverly overcome by the kinematic locking and unlocking system of the mop base that is the object of the invention.

What should be included is the equivalent kinematic system that, mutatis mutandis, in an active configuration holds the mop base closed, and in the resting state releases the mop base into an open state.

In order to provide the maximum versatility of use, also for left-handed operators, the kinematic locking and unlocking system is made available on both sides of the mop base with respect to the handle, united by a solid axis with hinging 8, that creates the interference for the locking and its rotation for the contemporaneous unlocking on both sides of the mop base with respect to the handle.

What is claimed is:

1. A mop base, comprising:

at least two half-frames, each half-frame substantially flat on outer sides, hinged together at a pivot along a common longitudinal axis, and capable of retaining a free edge of a mop inside a clasping mouth formed by a pair of longitudinal edges of corresponding sides of each half-frame, the mop base capable of assuming and maintaining stable open and closed positions with at least one hinged kinematic mechanism pivotally fixed with a first half-frame that, when the mop base is closed, is held down within a profile of a second half-frame, and when the mop base is opened about the common longitudinal axis by at least one elastic device, the at least one hinged kinematic mechanism projects above the profile of said second half-frame.

2. The mop base according to claim 1 wherein each hinged kinematic mechanism comprises a lever and one of the elastic devices, each lever being hinged with an axis parallel to the common longitudinal axis.

3. The mop base according to claim 2 wherein when the mop base is in the closed position each lever is contained inside the profile of the mop base and does not protrude beyond the profile of the first half-frame.

4. The mop base according to claim 2 wherein the mop base maintains the stable open position with a continual groove in the second half-frame having an axis parallel to the axis of the hinging of each lever, whereby when the lever engages the continual groove of the second half-frame the mop base is maintained in the open position.

5. The mop base according to claim 2 wherein the mop base maintains the stable open position with a continual groove in the second half-frame having an axis parallel to the axis of the hinging of each lever, and a cooperative tooth protruding above the lever, whereby when the tooth of each lever engages the continual groove of the second half-frame the mop base is maintained in the open position.

6. The mop base according to claim 5 wherein said groove and said tooth contact each other when the mop base is in the open position at mutual contact surfaces that are each perpendicular to the projection thereof through the axis of the hinging of the lever.

7. The mop base according to claim 5 wherein the protrusion of the lever is substantially perpendicular to the lever.

8. The mop base according to claim 2 wherein said lever has an inclined surface on which the second half-frame acts when rotating to close, forcing said lever to rotate down until the lever is completely within the second half-frame.

9. The mop base according to claim 2 having one of the hinged kinematic mechanisms rotationally fixed to the first half-frame at either side of a handle sleeve, the sleeve being rotationally fixed to the first half-frame by a single hinge.

* * * * *